US011471735B2

(12) United States Patent
Wang

(10) Patent No.: US 11,471,735 B2
(45) Date of Patent: Oct. 18, 2022

(54) HEAD FRAME OF GOLF BAG WITH SELF-LOCKING SUPPORT ROD

(71) Applicant: Youli Wang, Guangdong (CN)

(72) Inventor: Qiong Wang, Guangdong (CN)

(73) Assignee: Youli Wang, Shenzhen (CN)

( * ) Notice: Subject to any disclaimer, the term of this patent is extended or adjusted under 35 U.S.C. 154(b) by 36 days.

(21) Appl. No.: 17/315,195

(22) Filed: May 7, 2021

(65) Prior Publication Data

US 2021/0260450 A1 Aug. 26, 2021

(30) Foreign Application Priority Data

May 7, 2020 (CN) ..... 202010376078.9

(51) Int. Cl.
*A63B 55/50* (2015.01)
*A63B 55/40* (2015.01)

(52) U.S. Cl.
CPC ..... *A63B 55/50* (2015.10); *A63B 55/40* (2015.10)

(58) Field of Classification Search
CPC ..... A45B 55/50; A63B 55/40
USPC ..... 206/315.6
See application file for complete search history.

(56) References Cited

U.S. PATENT DOCUMENTS 8,726,464 B1 * 5/2014 Tong ..... A45C 13/262 16/113.1
2006/0185999 A1 * 8/2006 Keays ..... A63B 55/404 206/315.3

FOREIGN PATENT DOCUMENTS

CN 105999663 A 10/2016
CN 207153028 U 3/2018
CN 109316719 A 2/2019
GB 2203955 A * 11/1988 ..... A45C 3/00

* cited by examiner

*Primary Examiner* — Valentin Neacsu
*Assistant Examiner* — Jessica Kavni Tamil

(57) ABSTRACT

A head frame of a golf bag with a self-locking support rod includes a frame body, a through hole, a groove, a snap lock and a rotatable fixing shaft. The through hole, the groove, the snap lock and the rotatable fixing shaft are provided on the frame body. The snap lock is configured to rotate around the rotatable fixing shaft in the groove to open and automatically block the through hole. During use, the support rod can be freely inserted in the through hole, a bag body and a fixing hole at a bag base to straighten the golf bag.

6 Claims, 7 Drawing Sheets

HEAD FRAME OF GOLF BAG WITH SELF-LOCKING SUPPORT ROD

CROSS-REFERENCE TO RELATED APPLICATIONS

This application claims the benefit of priority from Chinese Patent Application No. 202010376078.9, filed on May 7, 2020. The content of the aforementioned application, including any intervening amendments thereto, is incorporated herein by reference in its entirety.

TECHNICAL FIELD

This application relates to recreational fitness equipment, and more particularly to a head frame of a golf bag with a self-locking support rod.

BACKGROUND

In the existing golf bags supported by a support rod, a support rod fixing hole at a head frame generally has one open end and the other closed end, causing a complex, laborious and slow assembling process of the support rod. Conventionally, a head frame body, a bag body and a base are first integrally fixed, and then one end of the support rod is inserted into a fixing hole at the base, and the other end of the support rod is manually bent to be inserted into the fixing hole at the head frame body. In view of this, the fixing holes at the head frame and the base cannot be designed to have a relatively large depth, and thus the support rod cannot provide stable support for the bag. In addition, when a support rod is assembled into a head frame of a bat bag, a lattice hole in the head frame is too small for hand to pass through, and thus it can not perform an assembly in the bat bag. Therefore, an opening is provided on a bag body of the bat bag to facilitate the assembling of the support rod. However, this design will affect the appearance and cause a complicated production and an increasing cost.

There is an urgent to design a new, flexible and simple head frame of a golf bag with a self-locking support rod to overcome defects in the prior art.

SUMMARY

An object of this application is to provide a head frame of a golf bag with a self-locking support rod to overcome defects in the prior art.

Technical solutions of this disclosure are described as follows.

This application provides a head frame of a golf bag with a self-locking support rod, comprising:

a frame body;

a through hole for fixing a support rod;

a groove; and a snap lock;

wherein the snap lock is provided in the groove; the through hole and the groove are provided on the frame body; a spring is provided in the snap lock; the snap lock and the spring are provided in the groove through a rotatable fixing shaft; and during use, the snap lock rotates with respect to the rotatable fixing shaft and moves away from the through hole, such that the support rod penetrates the through hole; and when an upper end of the support rod passes through the snap lock, a resilience of the spring enables the snap lock to automatically return to the through hole, thereby fixing the support rod on the frame body.

In an embodiment, the through hole comprises a plurality of through holes; the support rod comprises a plurality of support rods; the plurality of through holes and the plurality of support rods are in one-to-one correspondence; and the plurality of support rods penetrate the plurality of through holes and a bag body of the golf bag from top to bottom and are inserted into a plurality of fixing holes on a base of the golf bag, respectively.

In an embodiment, the groove is provided at the through hole, so that the snap lock rotates in the groove through the rotatable fixing shaft, and the groove limits an axial movement of the snap lock along the rotatable fixing shaft.

In an embodiment, one end of the spring is provided in the snap lock, and the other end of the spring abuts against the groove; and the spring is configured to allow the snap lock to automatically spring back, so that the snap lock automatically block the through hole.

In an embodiment, the snap lock is configured to rotate around the rotatable fixing shaft to open and automatically block the through hole, so that the support rod is locked in the golf bag in which the frame body, a bag body and a base are integrally fixed, thereby straightening the bag body to enable the golf bag to stand up.

In an embodiment, the snap lock comprises an end cover and a cavity; the end cover is configured to limit the upper end of the support rod; and the cavity is configured to accommodate the upper end of the support rod.

During use, the spring is assembled into the snap lock, and then the snap lock is fixed in the groove on the head frame body through the rotatable fixing shaft. The snap lock is rotated around the rotatable fixing shaft to open or automatically close the through hole on the frame body. When the snap lock is opened, one end of the support rod penetrates the through hole provided on the frame body and the bag body and is inserted into the fixing hole on the base of the golf bag. When the other end of the support rod passes through the snap lock, resilience of the spring enables the support rod to be locked in the golf bag in which the frame body, the bag body and the bag base are integrally fixed, thereby straightening the golf bag.

Compared to the prior art, this disclosure has the following beneficial effects.

The head frame provided herein facilitates simplifying the assembling process of the golf bag. The support rod can be freely inserted into the frame body, the bag body and the bag base by rotating the snap lock to straighten the golf bag, which makes the golf bag become more stable and firm, thereby improving operation efficiency and saving the cost.

Figure 1:
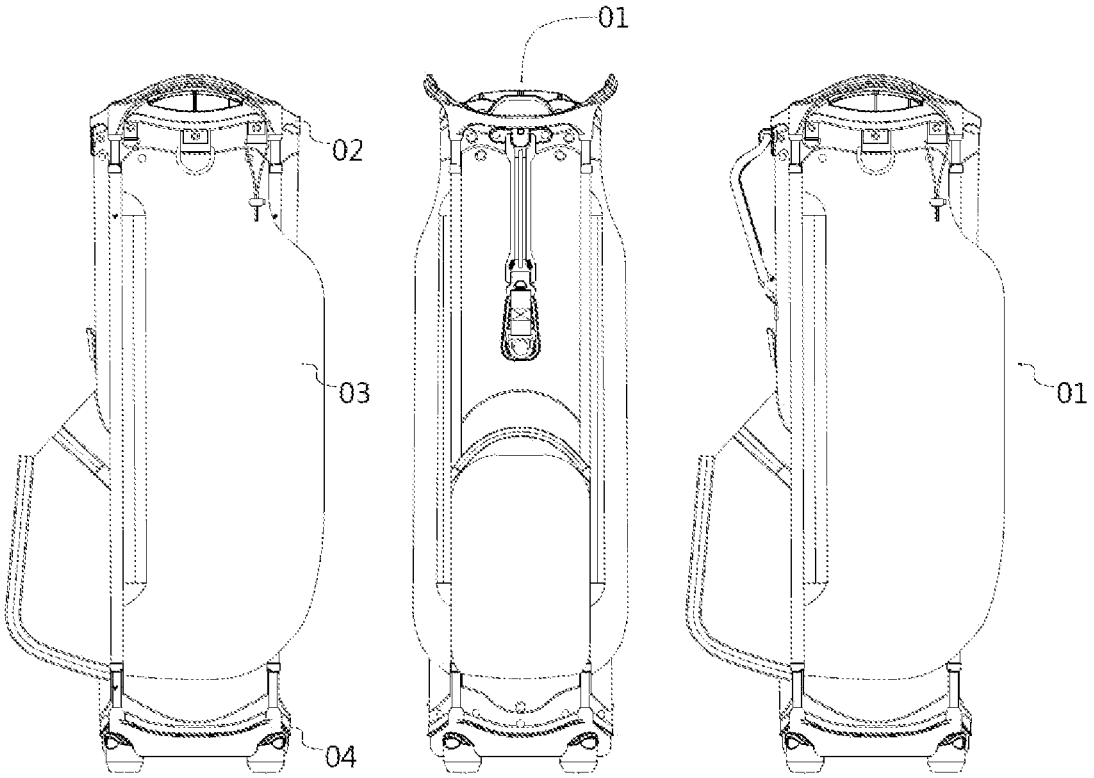
FIG. 1 is a three-view drawing of a golf bag with a self-locking support rod according to an embodiment of the present disclosure.
Figure 2:
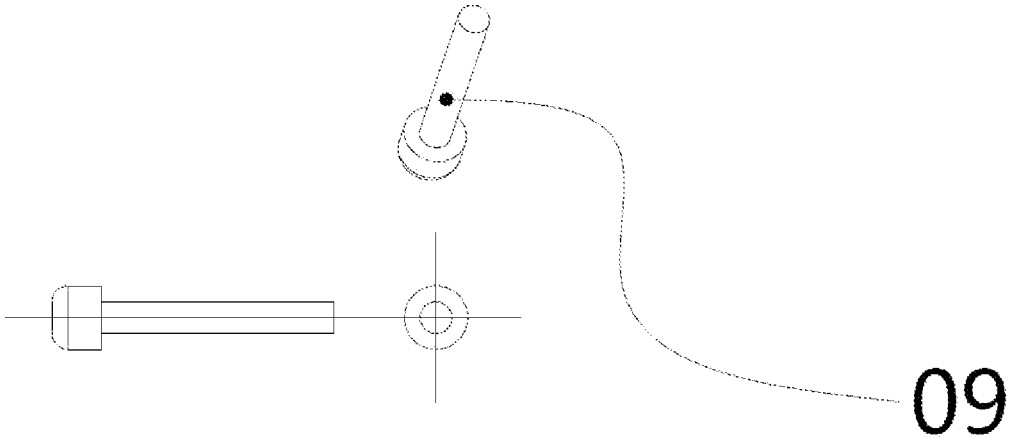
FIG. 2 is a three-view drawing of a rotatable fixing shaft of a head frame of the golf bag with the self-locking support rod according to an embodiment of the present disclosure.

In this drawings, 01, golf bag; 02, frame body; 03, bag body; 04, base; 05, support rod; 06, snap-lock groove; 07, snap lock; 08, spring; 09, rotatable fixing shaft; 10, through hole; 11, hole for fixing the rotatable fixing shaft; 12, fixing hole at base; 13, groove for fixing the spring; 14, mounting trajectory of the spring; 15, mounting trajectory of the snap lock; 16, mounting trajectory of the rotatable fixing shaft; 17, rotation trajectory of the snap lock; 18, fixing shaft hole of the snap lock; 19, upper end of the support rod; 20, lower end of support rod; 21, mounting trajectory of the support rod; 071, end cover; and 072, cavity.

DETAILED DESCRIPTION OF EMBODIMENTS

The present application will be further described in detail with reference to the accompanying drawings and embodiments to make technical solutions, features and effects of the application better understood.

An embodiment presented in FIGS. 1-12 provides a head frame of a golf bag with a self-locking support rod, which includes a frame body 02, a through hole 10 for fixing a support rod 05, a snap-lock groove 06 and a hole 11 for fixing a rotatable fixing shaft 09. The through hole 10, the snap-lock groove 06 and the hole 11 are provided on the flame body 02.

Figure 3:
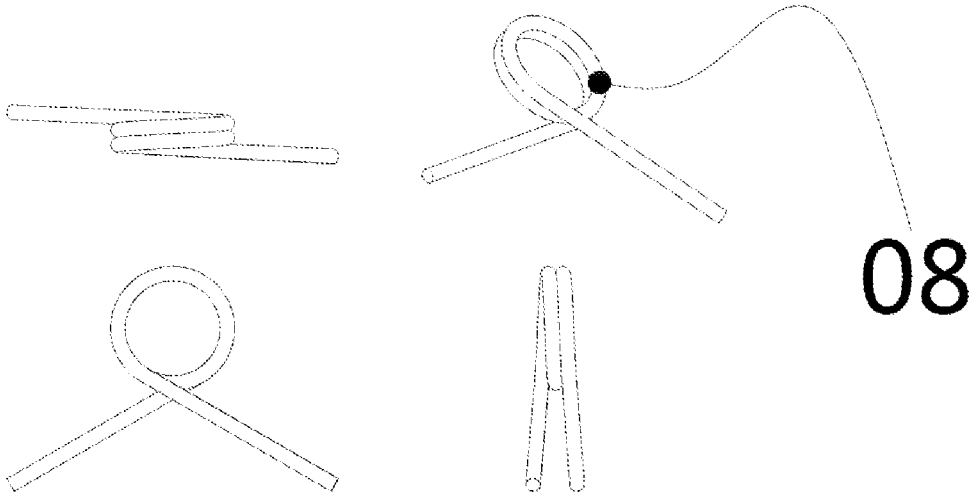
FIG. 3 is a three-view drawing of a spring of the head frame according to an embodiment of the present disclosure.
Figure 4:
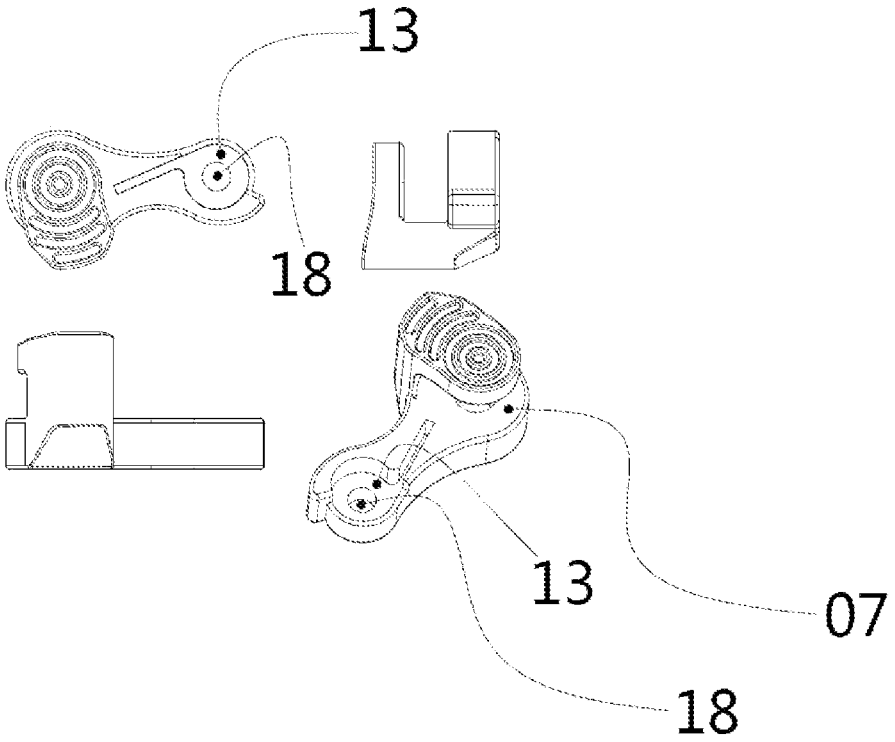
FIG. 4 is a three-view drawing of a snap lock of the head frame according to an embodiment of the present disclosure.
Figure 5:
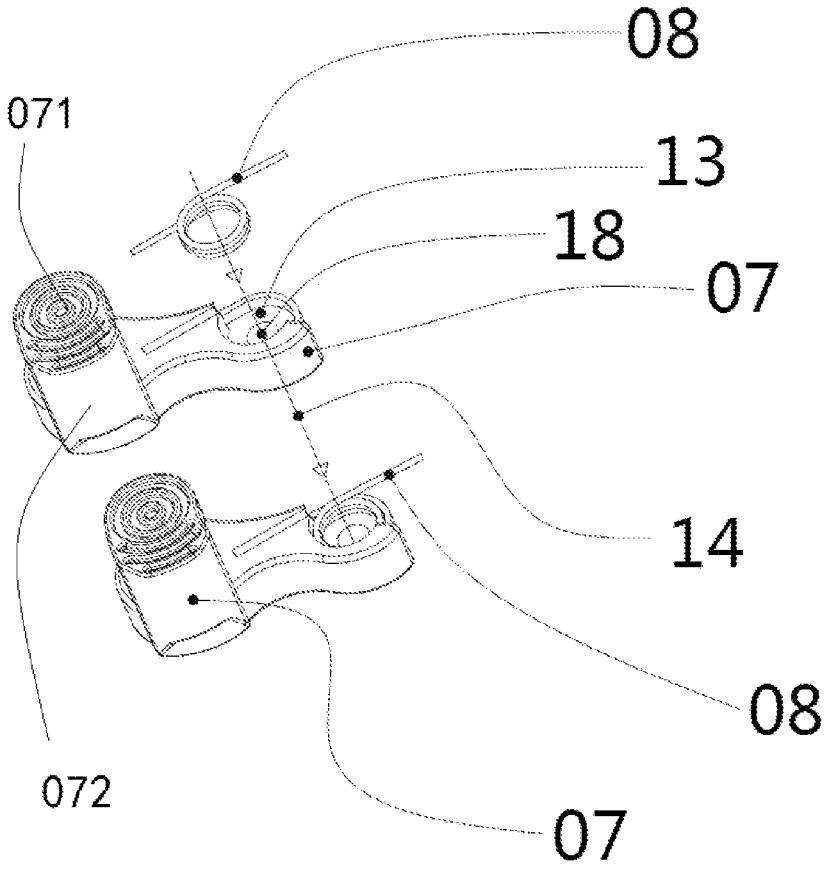
FIG. 5 schematically shows an assembly of the spring into the snap lock according to an embodiment of the present disclosure.
Figure 6:
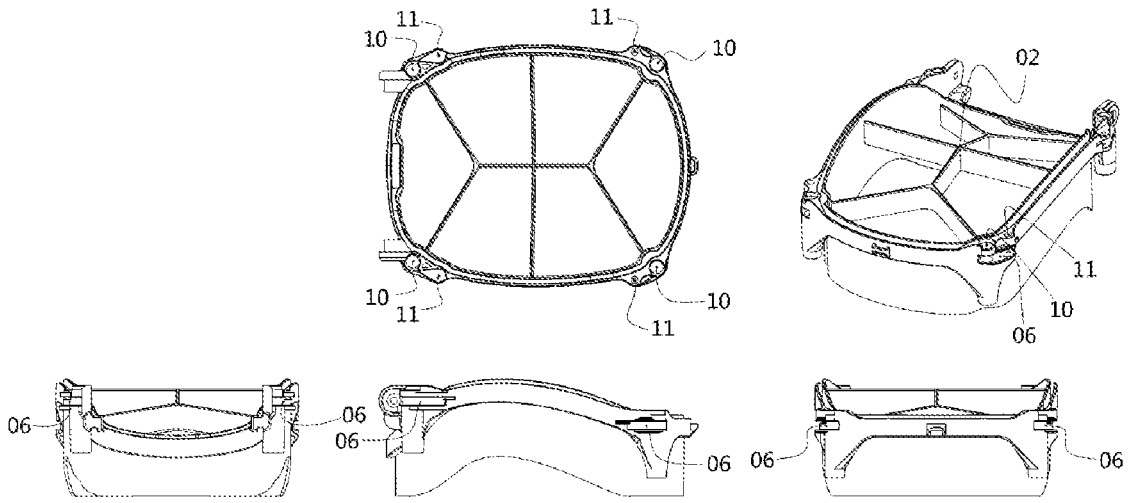
FIG. 6 is a three-view drawing of a frame body of the head frame according to an embodiment of the present disclosure.
Figure 7:
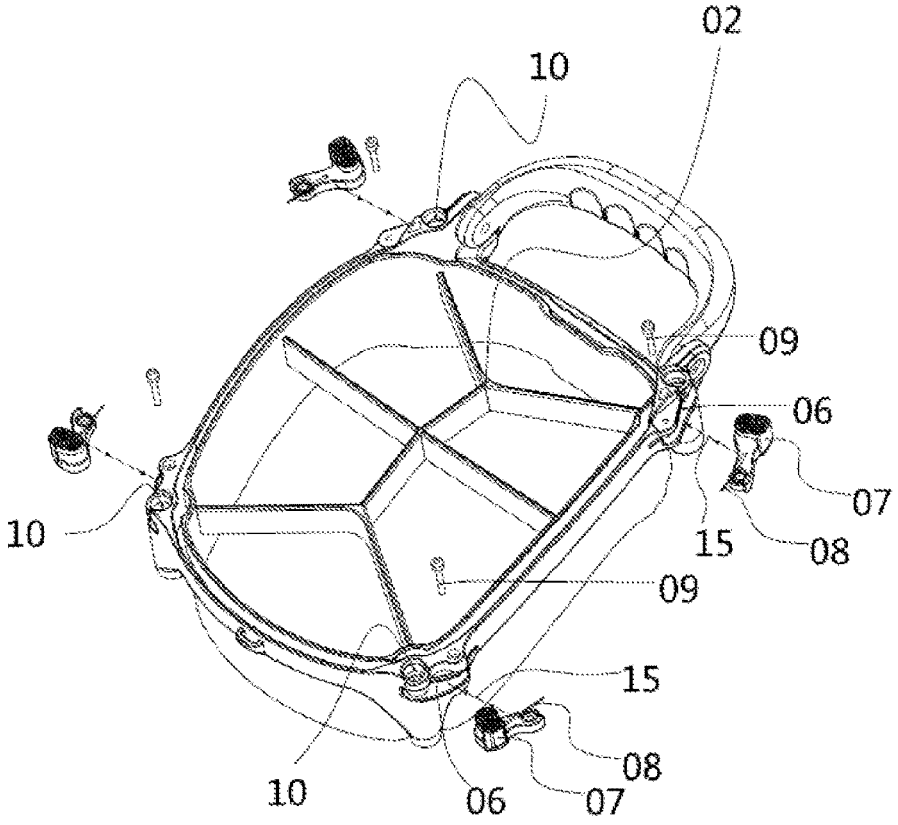
FIG. 7 schematically shows an assembly of the snap lock and the frame body according to an embodiment of the present disclosure.
Figure 8:
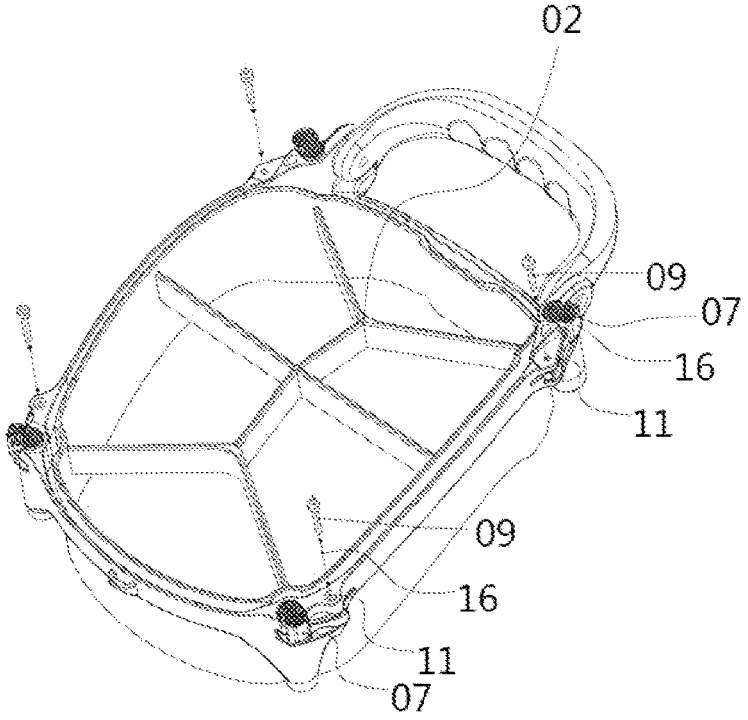
FIG. 8 schematically shows an assembly of the rotatable fixing shaft and the frame body according to an embodiment of the present disclosure.
Figure 9:
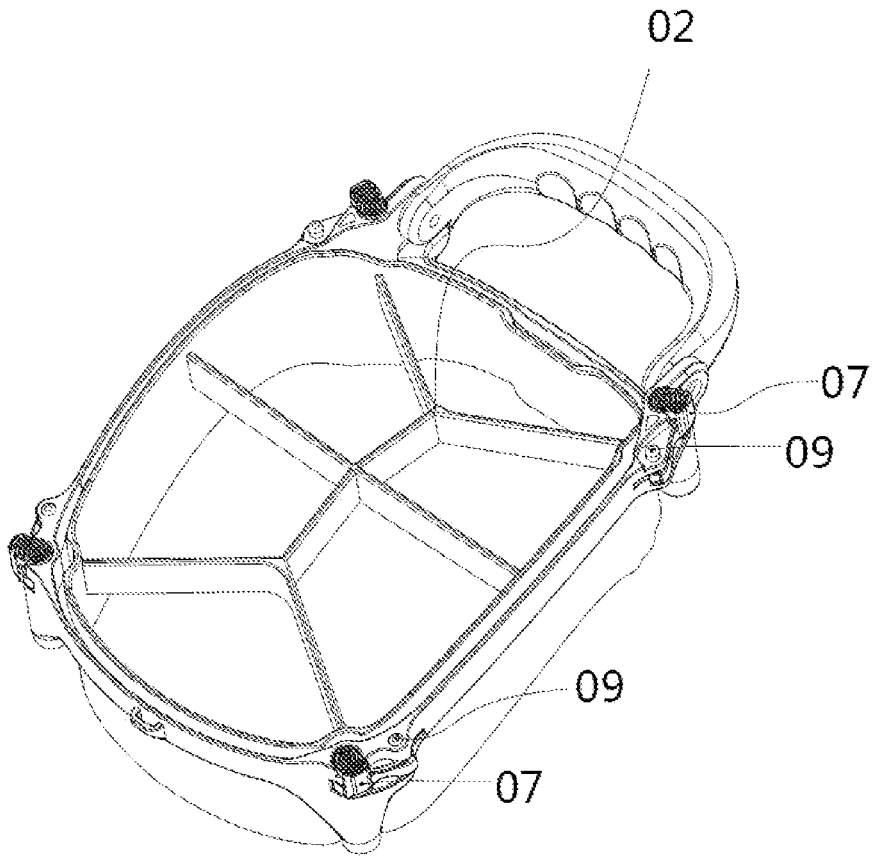
FIG. 9 is a perspective view showing an assembly of the frame body, the snap lock and the rotatable fixing shaft according to an embodiment of the present disclosure.
Figure 10:
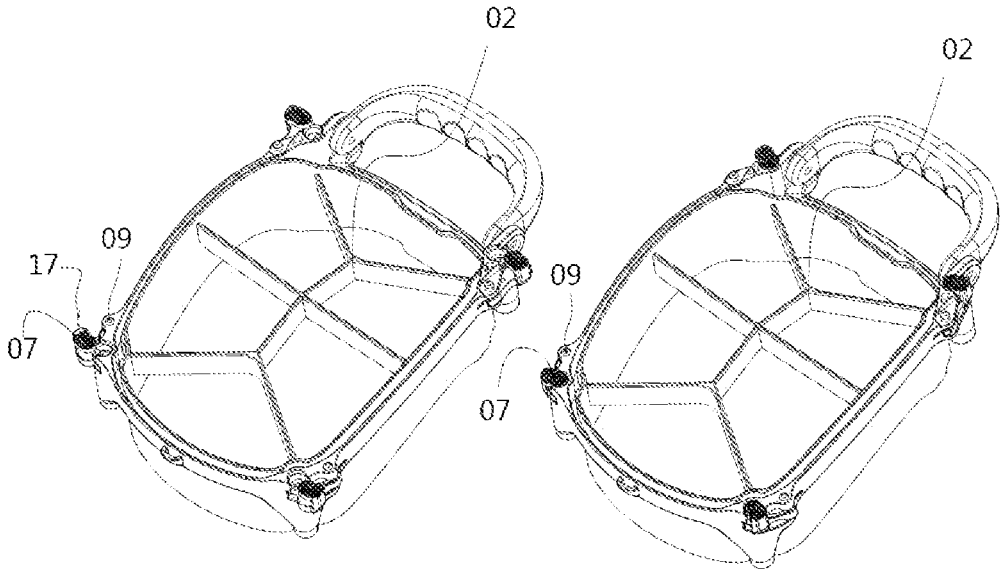
FIG. 10 schematically shows open and close of the snap lock in a snap-lock groove according to an embodiment of the present disclosure.
Figure 11:
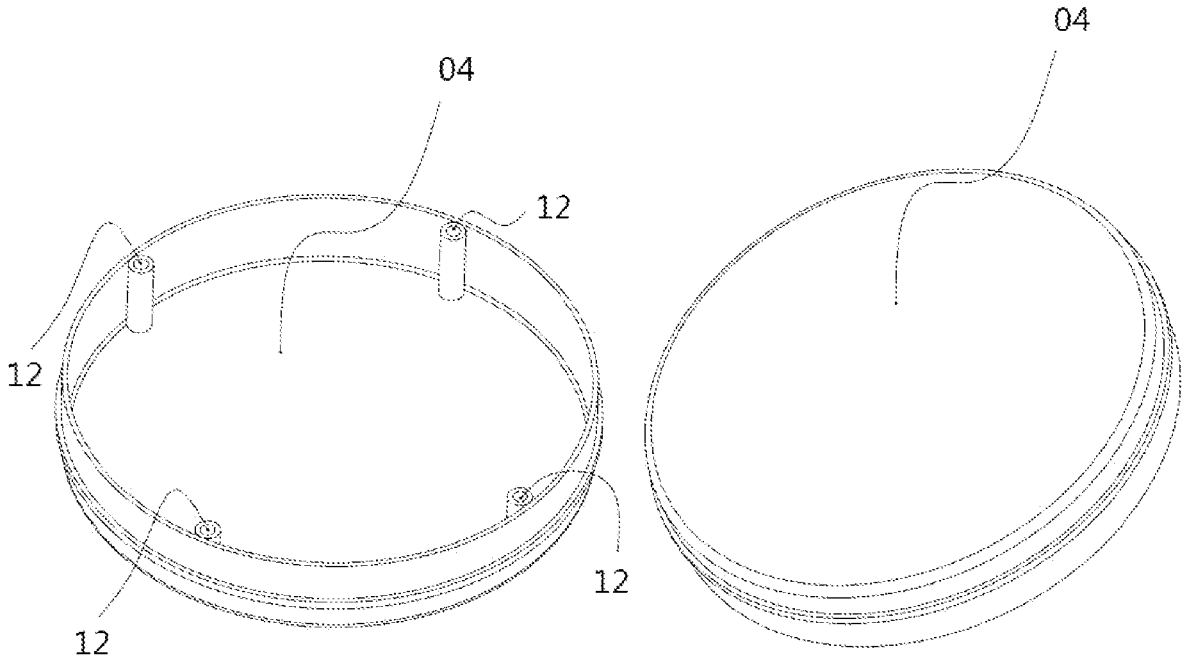
FIG. 11 is a perspective view of a bag base of the golf bag according to an embodiment of the present disclosure.
Figure 12:
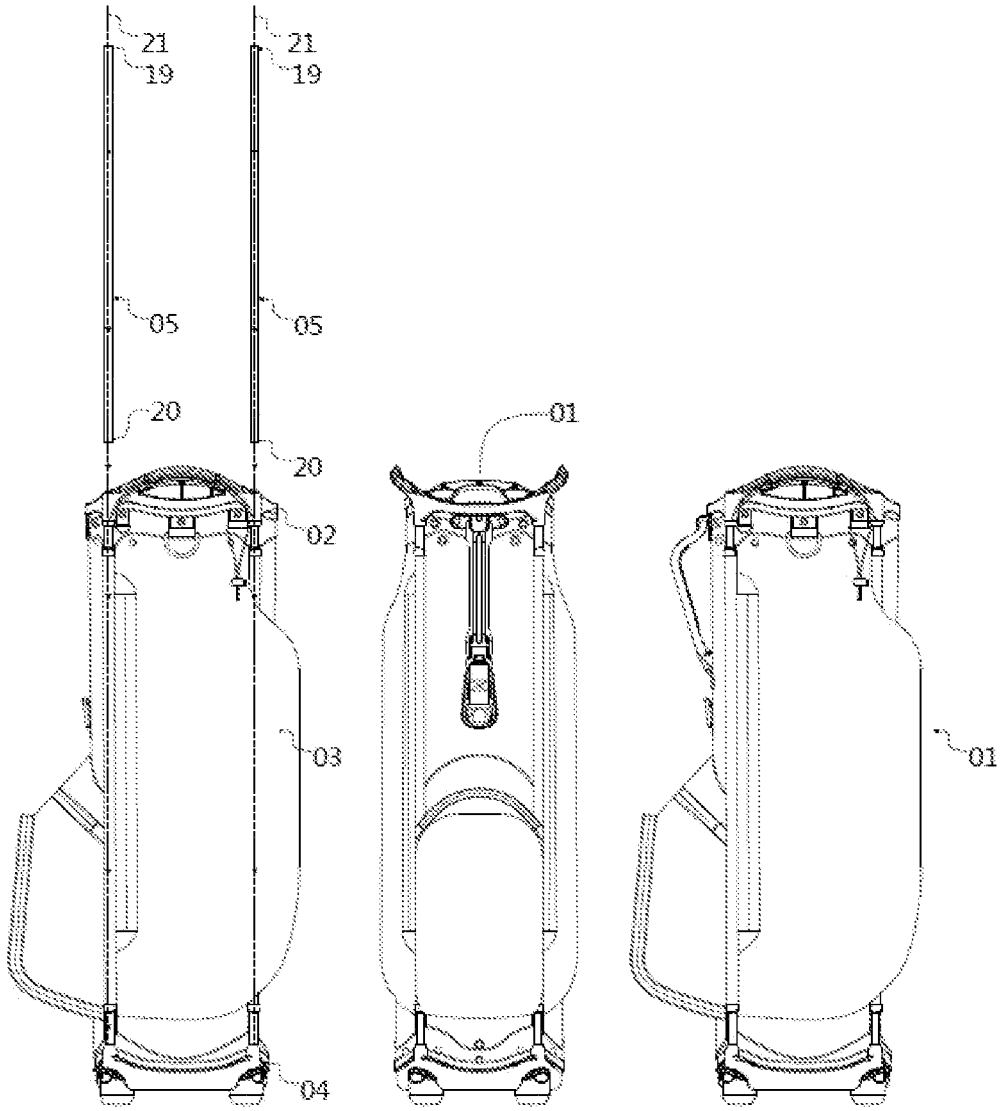
FIG. 12 schematically shows an assembly of the support rod and the golf bag according to an embodiment of the present disclosure.

As shown in FIGS. 3-5, a spring 08 is mounted in a groove 13 provided in a snap lock 07 for fixing spring along a mounting trajectory 14 of the spring 08.

As shown in FIGS. 3-5 and 7-9, the snap lock 07 provided with the spring 08 is mounted in a snap-lock groove provided in the flame body 02 along a mounting trajectory 15 of the snap lock 07. The rotatable fixing shaft 09 is rotated to penetrate a hole 11 for fixing the rotatable fixing shaft 09 and a fixing shaft hole 18 of the snap lock 07 along a mounting trajectory 16 of the rotatable fixing shaft 09, so that the snap lock 07 is locked in the snap-lock groove 06 provided on the flame body 02. The snap lock 07 includes an end cover 071 and a cavity 072. The end cover 071 is configured to limit an upper end 19 of the support rod 05. The cavity 072 is configured to accommodate the upper end 19 of the support rod 05. The cavity is semi-cylindrical to enable the upper end 19 of the support rod 05 to enter the cavity 072.

As show in FIGS. 1 and 10-12, the snap lock 07 is opened along a rotation trajectory 17 of the snap lock 07 to assemble the support rod 05. Specifically, the lock 07 is driven by external force to rotate with respect to the rotatable fixing shaft 09 to be away from the through hole 10 for fixing the support rod 05. A lower end 20 of the support rod 05 is inserted into the through hole 05 provided on the frame body 02 along a mounting trajectory 21 of the support rod 05. The support rod 05 penetrates the through hole 10 and a bag body 03 and is inserted in a fixing hole 12 provided on a base 04. When the upper end 19 of the support rod 05 passes through the snap lock 07, resilience of the spring 08 enables the snap lock 07 to automatically spring back to the snap-lock groove 06, so that the support rod 05 is fixed in a golf bag 01 in which the frame body 02, the bag body 03 and the base 04 are integrally fixed, thereby straightening the bag body 01 to enable the golf bag 01 to stand up.

Described above are merely preferred embodiments, which are not intended to limit the disclosure. It should be noted that any modification, change and replacement made by those skilled in the art without departing from the spirit of the disclosure should fall within the scope of the disclosure defined by the appended claims.

What is claimed is:

1. A head frame of a golf bag with a self-locking support rod, comprising:

a frame body;

a through hole for fixing a support rod;

a groove; and a snap lock;

wherein the snap lock is provided in the groove; the through hole and the groove are provided on the frame body; a spring is provided in the snap lock; the snap lock and the spring are provided in the groove through a rotatable fixing shaft; and during use, the snap lock rotates with respect to the rotatable fixing shaft and moves away from the through hole, such that the support rod penetrates the through hole; and when an upper end of the support rod passes through the snap lock, a resilience of the spring enables the snap lock to automatically return to the through hole, thereby fixing the support rod on the frame body.

2. The head frame of claim 1, wherein the through hole comprises a plurality of through holes; the support rod comprises a plurality of support rods; the plurality of through holes and the plurality of support rods are in one-to-one correspondence; and the plurality of support rods penetrate the plurality of through holes and a bag body of the golf bag from top to bottom and are inserted into a plurality of fixing holes on a base of the golf bag, respectively.

3. The head frame of claim 1, wherein the groove is provided at the through hole, so that the snap lock rotates in the groove through the rotatable fixing shaft, and the groove limits an axial movement of the snap lock along the rotatable fixing shaft.

4. The head frame of claim 1, wherein one end of the spring is provided in the snap lock, and the other end of the spring abuts against the groove; and the spring is configured to allow the snap lock to automatically spring back, so that the snap lock automatically block the through hole.

5. The head frame of claim 1, wherein the snap lock is configured to rotate around the rotatable fixing shaft to open and automatically block the through hole, so that the support rod is locked in the golf bag in which the frame body, a bag body and a base are integrally fixed, thereby straightening the bag body to enable the golf bag to stand up.

6. The head frame of claim 1, wherein the snap lock comprises an end cover and a cavity; the end cover is configured to limit the upper end of the support rod; and the cavity is configured to accommodate the upper end of the support rod.

* * * * *